US006577277B1

(12) United States Patent
Huang et al.

(10) Patent No.: US 6,577,277 B1
(45) Date of Patent: Jun. 10, 2003

(54) DUAL BAND ANTENNA

(75) Inventors: Chien-Hsun Huang, Tu-Chen (TW); Chih-Hsien Chou, San Jose, CA (US); Chung Ta Cheng, Santa Clara, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 32 days.

(21) Appl. No.: 10/032,089

(22) Filed: Dec. 21, 2001

(51) Int. Cl.[7] ..... H01Q 1/38
(52) U.S. Cl. ..... 343/700 MS; 343/702
(58) Field of Search ..... 343/700 MS, 702, 343/846, 848

(56) References Cited

U.S. PATENT DOCUMENTS 6,473,044 B2 * 10/2002 Manteuffel et al. .. 343/700 MS

* cited by examiner

*Primary Examiner*—Michael C. Wimer
(74) *Attorney, Agent, or Firm*—Wei Te Chung

(57) ABSTRACT

An antenna (1) includes a first radiating branch (20), a second radiating branch (30), a grounding plate (40), a linking segment (121), a connecting plate (60), and a feed cable (50). The first radiating branch is in a first plane and is provided to receive/transmit signals in a first frequency band. A feed point (21) is formed on the first radiating branch. The second radiating branch is in a second plane perpendicular to the first plane and is provided to receive/transmit signals in a second frequency band. The grounding plate is in a third plane facing the first plane for fixing and grounding the antenna. The feed cable includes a core conductor (51) and an outer shield conductor (53). The core conductor is electrically connected to the feed point for feeding signals into the antenna. The outer shield conductor is soldered to the grounding plate.

20 Claims, 8 Drawing Sheets

DUAL BAND ANTENNA

FIELD OF THE INVENTION

The present invention relates to antennas, and more particularly, to dual band antennas having elements positioned in different planes.

BACKGROUND OF THE INVENTION

With current developments in communication technology, many electronic devices need antennas which can receive and transmit signals in two frequency ranges. FIG. 10 shows a conventional dual band antenna. The conventional antenna is a planar inverted-F antenna and includes a planar radiating element 600. The radiating element 600 is divided by a non-conductive slot 601-602-603 into a first radiating branch located within a second radiating branch. A grounding plate 606 is located beneath and is electrically connected to the two branches. The two radiating branches and the grounding plate 606 are on a same planar surface. However, this planar structure antenna occupies a relatively large space in an electrical device and must be mounted onto a planar surface. The antenna is not very adaptable to installation in spaces having an irregular shape.

The present invention is directed to an improved dual band antenna, bended to position its elements in different planes, thereby occupying a relatively small space in an electrical device and being mountable into installation spaces having irregular shapes.

BRIEF SUMMARY OF THE INVENTION

A main object of the present invention is to provide a dual band antenna occupying a relatively small space in an electrical device.

Another object of the present invention is to provide an antenna which is capable of being mounted into an installation space having an irregular shape.

A dual band antenna in accordance with the present invention comprises a first radiating branch, a second radiating branch, a grounding plate, a connecting plate, and a feed cable. The first radiating branch is in a first plane and is provided for receiving/transmitting signals in a first frequency band. A feed point is located on the first radiating branch. The second radiating branch is in a second plane perpendicular to the first plane and is provided for receiving/transmitting signals in a second frequency band. The grounding plate is in a third plane parallel to and facing the first plane and is soldered to an electrical device for fixing and grounding the antenna. The feed cable comprises a core conductor and an outer shield conductor around the core conductor. The core conductor is electrically connected to the feed point for feeding signals into the antenna. The outer conductor is soldered to the grounding plate.

The dual band antenna is bended so that the first and second radiating branches and the grounding plate of the antenna are each in a different plane. The antenna, therefore, occupies a relatively small area on a PCB or other surface in an electrical device. The angles between the first and second planes and between the second and third planes can be varied to fit a contour and size of an installation space of the electrical device, providing greater flexibility for fitting into the space. Additionally, this bended structure of the dual band antenna can change radiation patterns of the antenna to fit differing requirements.

Other objects, advantages and novel features of the invention will become more apparent from the following detailed description when taken in conjunction with the accompanying drawings.

DETAILED DESCRIPTION OF THE INVENTION

Figure 1:
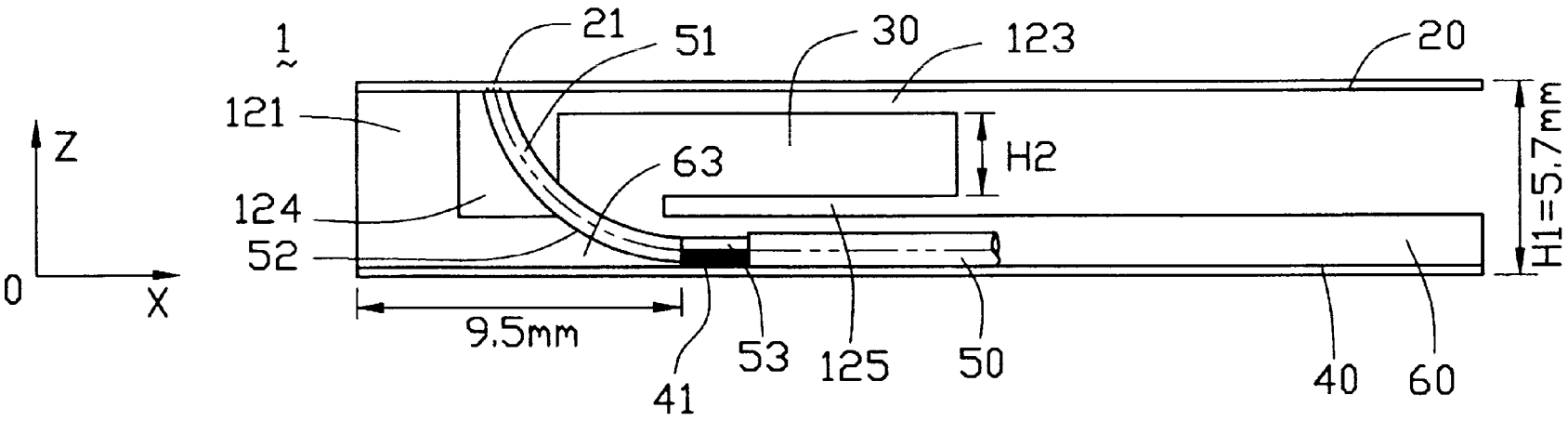
FIG. 1 is a frontal view of a dual band antenna of the present invention.
Figure 2:
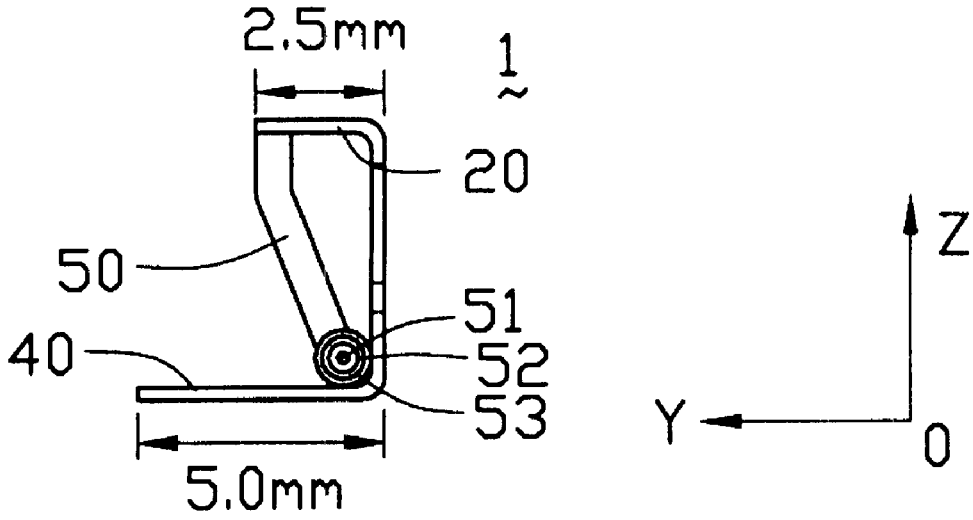
FIG. 2 is a right side view of the dual band antenna of FIG. 1.
Figure 3:
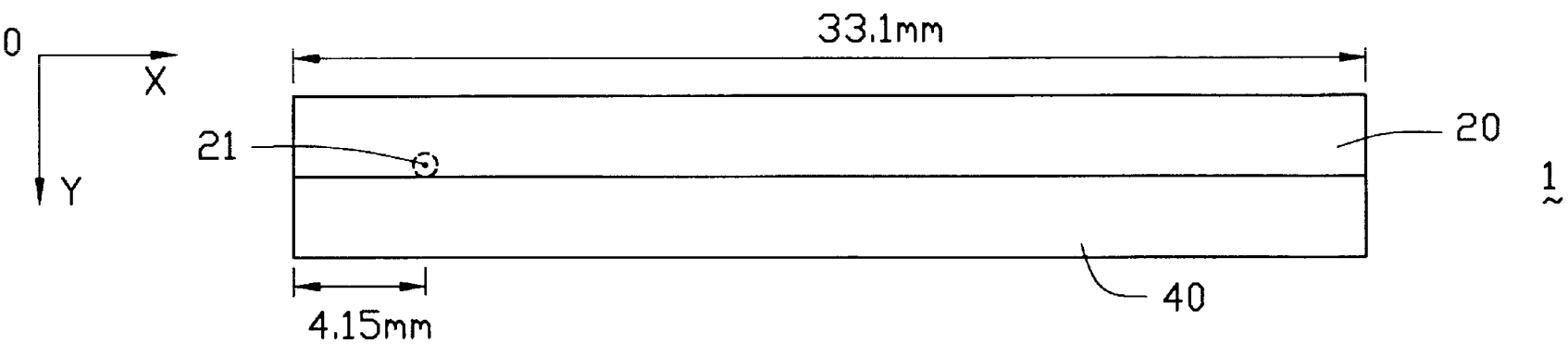
FIG. 3 is a top view of the dual band antenna of FIG. 1.

As shown in FIGS. 1, 2 and 3, a dual band antenna 1 according to a first embodiment of the present invention is a planar inverted-F antenna, comprising a first radiating branch 20, a second radiating branch 30, a grounding plate 40, a linking segment 121, and a connecting plate 60, all preferably made from one sheet of punched, bended metal plate, plus a feed cable 50.

The first radiating branch 20 is rectangular and is positioned in a first plane. A length of the first radiating branch 20 is chosen to promote electromagnetic resonation of the first radiating branch 20 in a predetermined first frequency band. A feed point 21 is located on a lower surface and near a front edge of the first radiating branch 20.

The linking segment 121, also rectangular in shape, extends downwardly from a left portion of a rear edge of the first radiating branch 20. The connecting plate 60, also rectangular, joins to the linking segment 121 at a lower edge of the linking segment 121 and extends rightwardly from the linking segment 121. The second radiating branch 30, is L-shaped and extends upwardly from an upper edge of the connecting plate 60. A length and width H2 of the second radiating branch 30 is chosen to promote resonation of the second radiating branch 30 in a predetermined second frequency band. The second radiating branch 30, the linking segment 121, and the connecting plate 60 are all located in a second plane perpendicular to the first plane. Three non-conductive slots 123, 124 and 125 (preferably air slots) separate respectively the second radiating branch 30 from the first radiating branch 20, the linking segment 121 from the second radiating branch 30, and a majority of the second radiating branch 30 from the connecting plate 60. A matching portion 63 is located in a section of the connecting plate 60 adjacent the joint of the second radiating branch 30 and the connecting plate 60.

The grounding plate 40 is rectangular and extends forwardly in a third plane, joining with a lower edge of the connecting plate 60. The grounding plate 40 is soldered to a portion (not shown) of an electrical device (not shown) for grounding and fixing the dual band antenna 1. The third plane intersects the second plane, and is parallel to the first plane.

The feed cable 50 has a core conductor 51 electrically connecting with the feed point 21 for transmitting signals between the dual band antenna 1 and a signal unit (not shown, since such circuits are well known in the art) of the electrical device. The feed cable 50 further has an outer shield conductor 53, which is soldered to the grounding plate 40 at a solder point 41 for grounding the dual band antenna 1. An insulative layer 52 separates the core conductor 51 from the outer shield conductor 53 along the length of the feed cable 50. The layer 52 and the core conductor 51 are stripped of the outer shield conductor 53 starting at the solder point 41 and extend proximate the matching portion 63. This length of stripped core conductor 51 with the insulative layer 52 and the matching portion 63 together form a capacitance for matching the impedance of the dual band antenna 1 to the impedance of the feed cable 50. The impedance of the dual band antenna 1 can be conveniently predetermined to match the impedance of the feed cable 50 by varying the relative areas of and distance between the stripped core conductor 51 and the matching portion 63.

In this embodiment, the feed point 21 is located near the front edge of the first radiating branch 20, thereby feeding the signals into the dual band antenna 1 in a side-feed manner. Alternatively, the feed point 21 may be located on a central portion (not labeled) of the lower surface (part way toward the rear edge) of the first radiating branch 20, thereby feeding the signals into the dual band antenna 1 in a center-feed manner.

The first plane is parallel to the third plane and perpendicular to the second plane in this embodiment. The first and the second radiating branches 20, 30, and the grounding plate 40 of the dual band antenna 1, therefore, are bent onto three different planes. However, the angles between the first and the second planes and between the second and third planes can be varied to allow the antenna to fit a contour and size of an installation space of the electrical device, providing flexibility for fitting into the space. Also, changes in the angles between planes of this bended structure of the dual band antenna 1 change the radiation patterns of the antenna, so angles between planes can be altered to provide radiation patterns which meet requirements.

Figure 4:
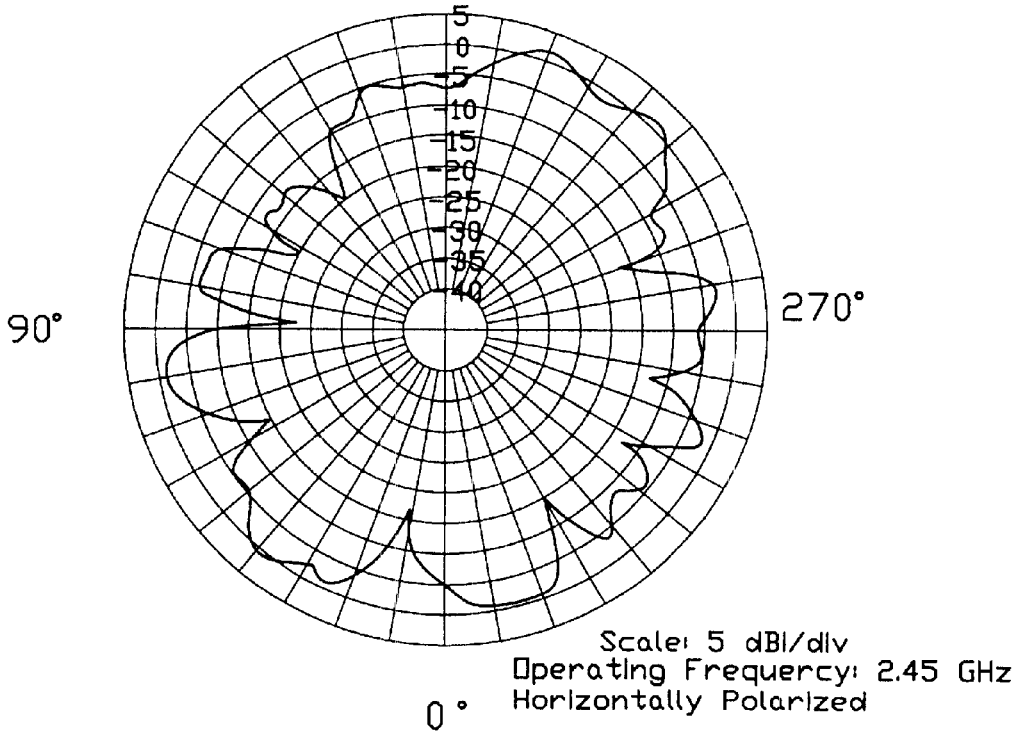
FIG. 4 shows a horizontally polarized principle plane radiation pattern (where the principle plane is an X-Y plane) of the dual band antenna of FIG. 1, operating at a first frequency of 2.45 GHz.
Figure 5:
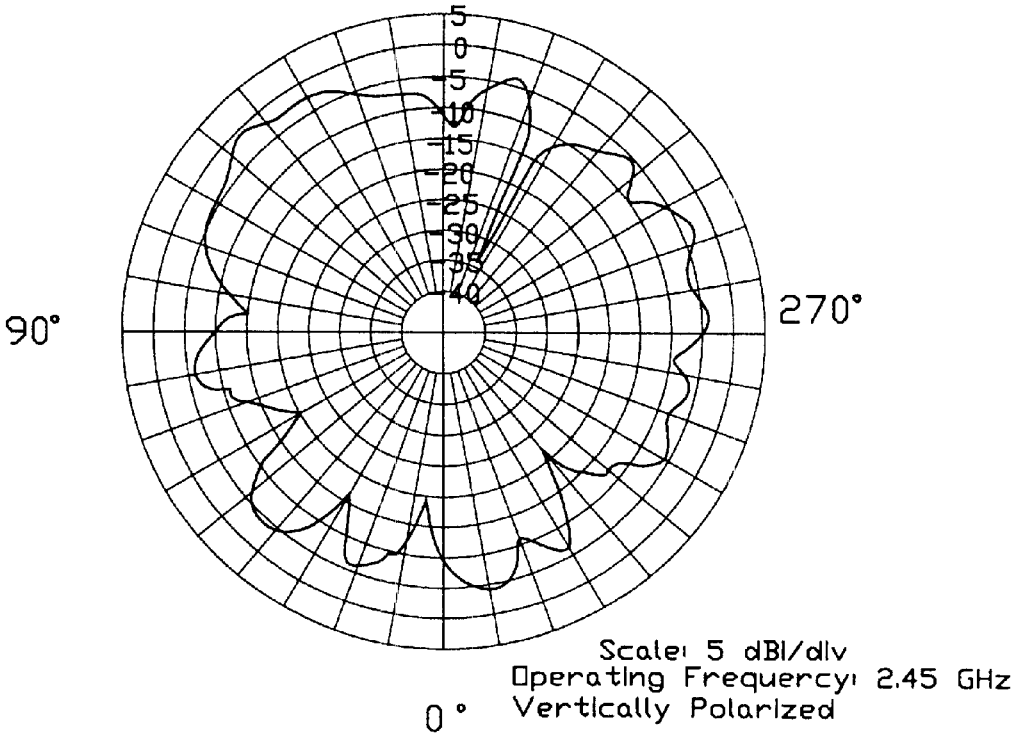
FIG. 5 shows a vertically polarized principle plane radiation pattern (where the principle plane is an X-Y plane) of the dual band antenna of FIG. 1, operating at a first frequency of 2.45 GHz.
Figure 6:
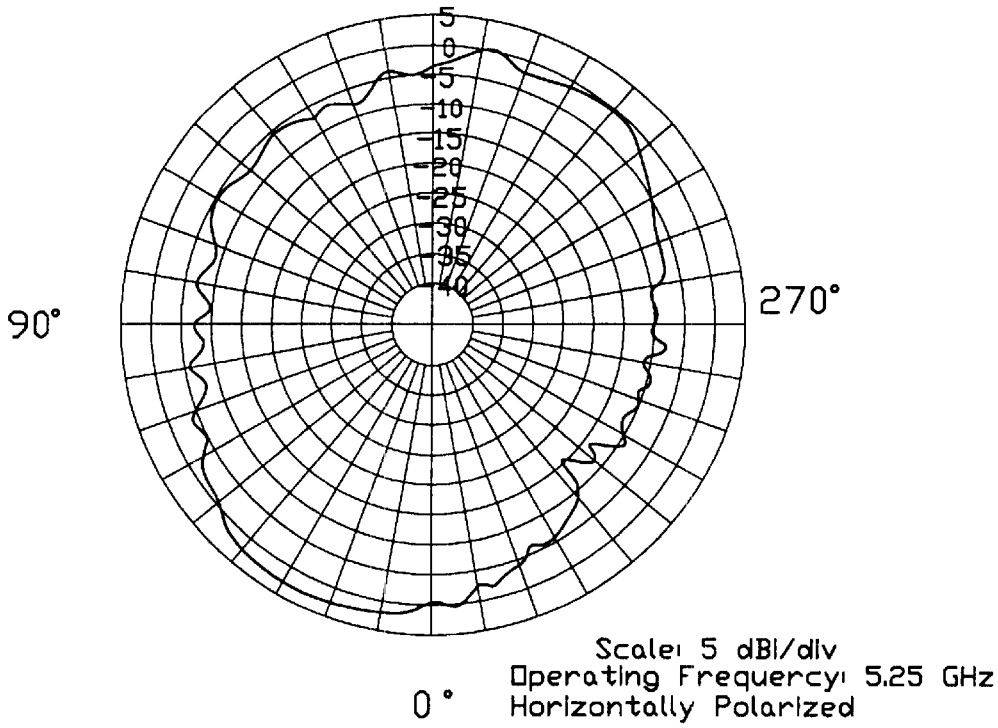
FIG. 6 shows a horizontally polarized principle plane radiation pattern (where the principle plane is an X-Y plane) of the dual band antenna of FIG. 1, operating at a second frequency of 5.25 GHz.
Figure 7:
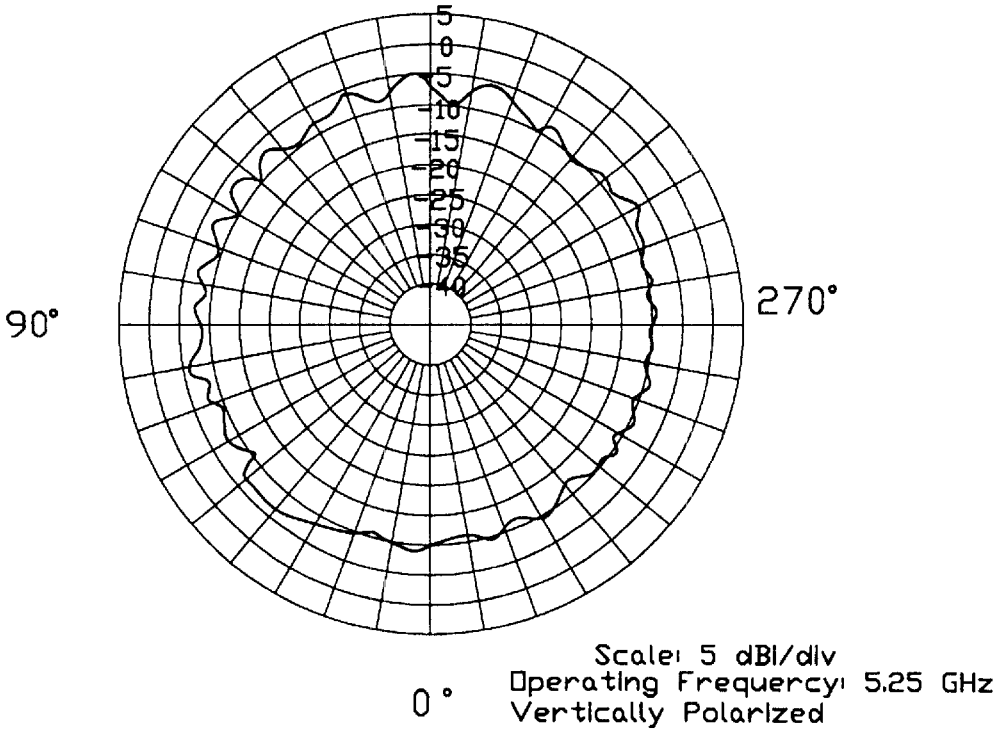
FIG. 7 shows a vertically polarized principle plane radiation pattern (where the principle plane is an X-Y plane) of the dual band antenna of FIG. 1, operating at a first frequency of 5.25 GHz.

The dual band antenna 1 is capable of transmitting and receiving in two different frequency bands. The first radiating branch 20 receives and transmits in a first, lower frequency band because its size is appropriate for the first frequency band. Likewise, the second radiating branch 30 receives and transmits in a second, higher frequency band because its size is appropriate for the second frequency band. In this embodiment, the operating frequency of the first radiating branch 20 is 2.45 GHz. FIGS. 4 and 5 respectively show horizontally and vertically polarized principle plane radiating patterns of the first radiating branch 20 at 2.45 GHz (the principle plane is the X-Y plane shown in FIG. 3.). The operating frequency of the second radiating branch 30 is 5.25 GHz. FIGS. 6 and 7 respectively show horizontally and vertically polarized principle plane radiating patterns of the second radiating branch 30 at 5.25 GHz (the principle plane is the X-Y plane shown in FIG. 3). Detailed dimensions of the dual band antenna 1 for operating in these frequency bands are shown in FIGS. 1, 2 and 3.

A first bandwidth of the first, lower frequency band of the antenna 1 is proportional to a height H1 (or a distance between the first radiating branch 20 and the grounding plate 40) of the antenna 1. The greater H1 is, the wider the first bandwidth of the antenna 1 is. A second bandwidth of the second, higher frequency band of the antenna 1 is proportional to the height H2 of the second radiating branch 30. The greater H2 is, the wider the second bandwidth is.

Figure 8:
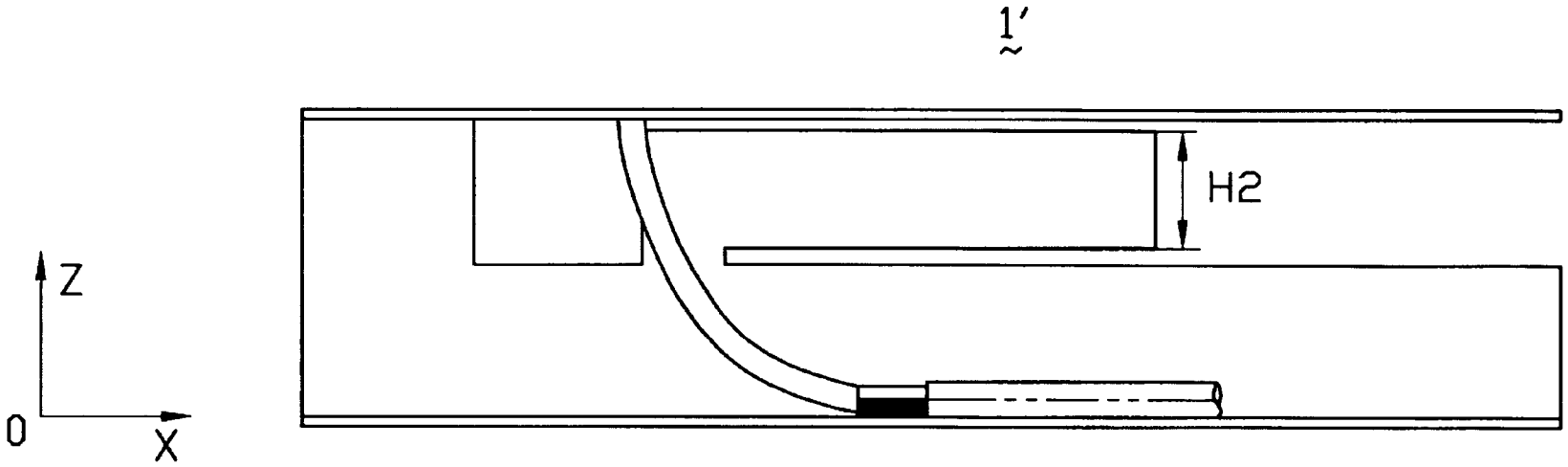
FIG. 8 is similar to FIG. 1, illustrating a second embodiment of the invention, which has several larger dimensions than the first embodiment.
Figure 9:
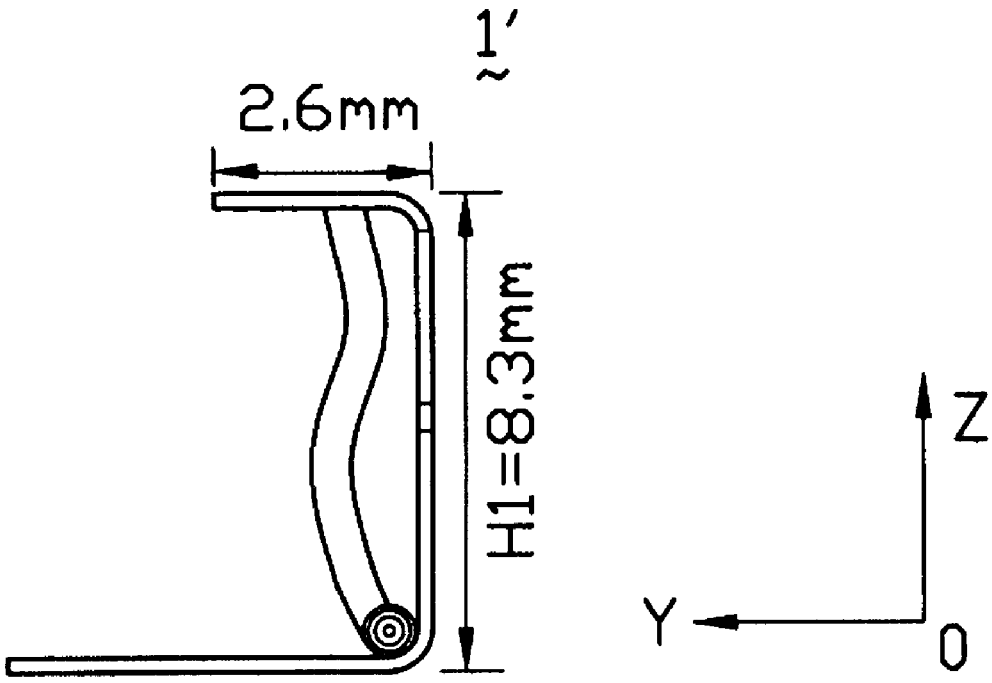
FIG. 9 is a right side view of FIG. 8.
Figure 10:
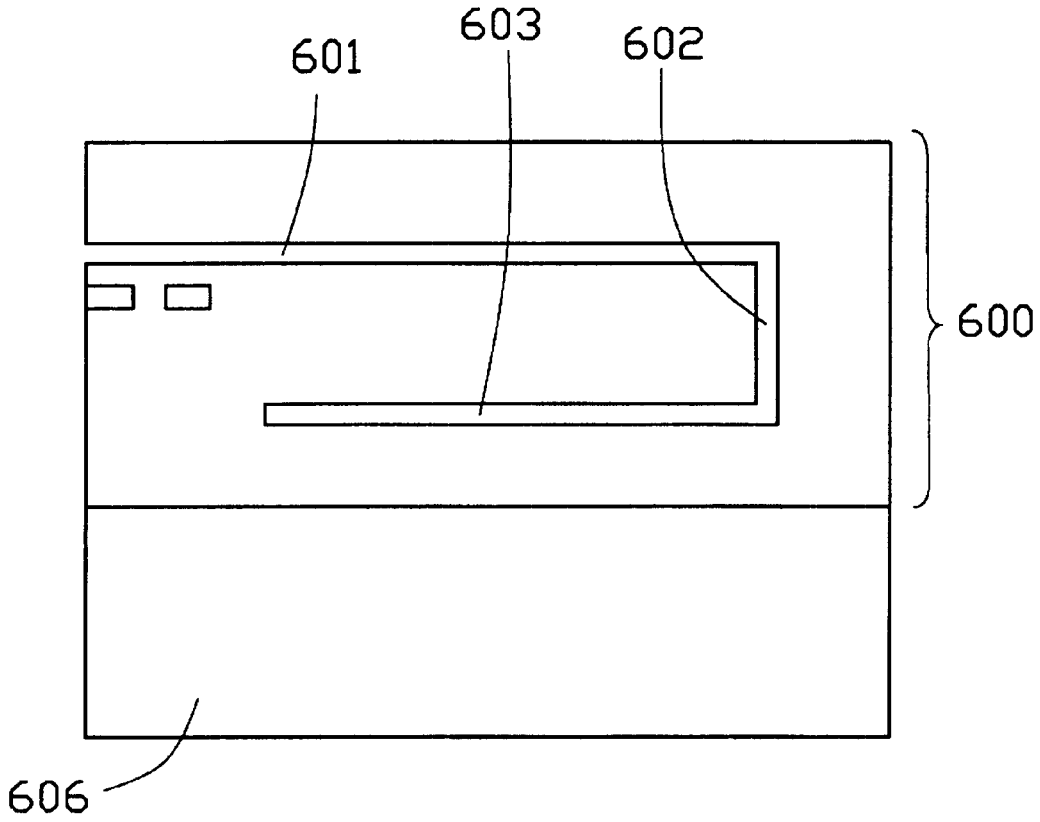
FIG. 10 (PRIOR ART)
FIG. 10 is a conventional antenna.

FIGS. 8 and 9 show a second embodiment antenna 1' of the present invention, which has several larger dimensions than those of the first embodiment 1 shown in FIGS. 1–3. The frequency bands of the second embodiment antenna 1' are correspondingly wider than those of the first embodiment. Several of the dimensions of the second embodiment are shown in FIGS. 8 and 9. Of course, other dimensions can be varied, as well.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna mounted in an electrical device, comprising:

a first radiating branch being in a first plane and receiving/transmitting signals in a first frequency band, the first radiating branch having a feed point thereon;

a second radiating branch being in a second plane and receiving/transmitting signals in a second frequency band, the second plane intersecting the first plane;

a grounding plate being in a third plane for fixing and grounding the antenna; and a feed cable comprising a core conductor and an outer shield conductor around the core conductor, the core conductor being electrically connected to the feed point, the outer shield conductor being electrically connected to the grounding plate.

2. The antenna as claimed in claim 1, wherein a linking segment and a connecting plate are provided in the second plane to interconnect the first and the second radiating branches, the linking segment joining the first radiating branch to the connecting plate, the connecting plate joining the linking segment to the grounding plate, and the second radiating branch extending from the connecting plate.

3. The antenna as claimed in claim 2, wherein an impedance matching portion is located on the connecting plate near a joint of the second radiating branch and the connecting plate.

4. The antenna as claimed in claim 3, wherein the feed cable further comprises an insulative layer separating the core conductor from the outer shield conductor along the length of the feed cable, and wherein a length of the core conductor and the insulative layer which is stripped of the outer shield conductor is used together with the impedance matching portion to form a capacitance for matching an impedance of the antenna to an impedance of the feed cable.

5. The antenna as claimed in claim 1, wherein the first plane is perpendicular to the second plane, and the third plane is parallel to the first plane.

6. The antenna as claimed in claim 1, wherein the angle between the first and the second planes and between the second and third planes can each be changed to an obtuse angle or to an acute angle to adjust the radiating patterns of the first and second radiating branches.

7. The antenna as claimed in claim 1, wherein a first bandwidth of the first frequency band of the antenna is proportional to a distance between the first plane and the third plane.

8. The antenna as claimed in claim 1, wherein a second bandwidth of the second frequency band of the antenna is proportional to a height of the second radiating branch.

9. The antenna as claimed in claim 1, wherein the feed point is located near an edge of the first radiating branch, thereby feeding signals into the antenna in a side-feed manner.

10. The antenna as claimed in claim 1, wherein the feed point is located at a center portion of the first radiating branch, thereby feeding signals into the antenna in a center-feed manner.

11. An antenna for use with an electrical device comprising:

a one-piece metal sheet defining a longitudinal direction thereof and including:

a first radiating branch defining a first plane for receiving/transmitting signals in a first frequency band;

a second radiating branch defining a second plane for receiving/transmitting signals in a second frequency band;

a grounding plate defining a third plane for grounding;

a feed cable comprising a core conductor and an outer shield conductor around said core conductor, said core conductor connecting to one of said first and second radiating branches, the outer shield conductor connecting to the grounding plate; wherein said first plane and said third plane intersect said second plane around two ends of said second plane thereof, and said first plane and said third plane positioned on a same side with regard to said second plane so as to form a space among said first, second and third planes in which said feed cable extends.

12. The antenna as claimed in claim 11, wherein said first plane is perpendicular to said second plane.

13. The antenna as claimed in claim 11, wherein said third plane is perpendicular to said second plane.

14. The antenna as claimed in claim 11, wherein a first non-conductive slot is formed around an intersection of said first radiating branch and said second radiating branch along said longitudinal direction.

15. The antenna as claimed in claim 14, wherein a second non-conductive slot is formed around said second radiating branch in a direction perpendicular to said longitudinal direction and in communication with said first non-conductive slot.

16. The antenna as claimed in claim 14, where a third non-conductive slot is formed around said second radiating branch along said longitudinal direction parallel to and spaced from said first non-conductive slot.

17. The antenna as claimed in claim 11, wherein a connecting plate is formed along said second plane and interconnected with said grounding plate to form an L-shaped configuration where the cable is seated.

18. An antenna comprising:

a one-piece metal sheet extending along a longitudinal direction with a U-like cross-sectional structure defined by two opposite arms connected by a bight therebetween, said metal sheet including:

a first radiating branch and a grounding plate located on said opposite arms, respectively, and a second radiating branch located on said bight;

a feed cable including inner and outer conductors respectively connected to said first radiating branch and said grounding plate; wherein said feed cable extends in an interior defined by said U-like cross-sectional configuration.

19. The antenna as claimed in claim 18, wherein said first radiating branch defines a smaller lateral dimension, perpendicular to said longitudinal direction, than said grounding plate.

20. The antenna as claimed in claim 18, wherein said first radiating branch defines a larger lengthwise dimension, along said longitudinal direction, than the second radiating branch.

* * * * *